US007568902B2

(12) United States Patent
Thomas

(10) Patent No.: US 7,568,902 B2
(45) Date of Patent: Aug. 4, 2009

(54) BITUMEN BALE CAPSULE, CAPSULE DISPENSER, AND BALE STRIP FORMER FOR VISCOUS BITUMEN PRODUCTS

(75) Inventor: Gordon William Thomas, Kuala Lumpur (MY)

(73) Assignee: Eastern Petroleum SDN BHD, Kuala Lumpur (MY)

( * ) Notice: Subject to any disclaimer, the term of this patent is extended or adjusted under 35 U.S.C. 154(b) by 417 days.

(21) Appl. No.: 11/383,664

(22) Filed: May 16, 2006

(65) Prior Publication Data

US 2006/0278343 A1 Dec. 14, 2006

(30) Foreign Application Priority Data

Jun. 8, 2005 (MY) ..... PI20052601

(51) Int. Cl.
*B29C 47/14* (2006.01)

(52) U.S. Cl. ..... 425/131.1; 425/133.5; 425/375; 425/804

(58) Field of Classification Search ..... 425/5, 425/130–133.5, 375, 804
See application file for complete search history.

(56) References Cited

U.S. PATENT DOCUMENTS 4,539,262 A 9/1985 Hurst
5,236,642 A * 8/1993 Blemberg et al. ..... 425/133.5
5,254,385 A 10/1993 Hazlett
5,316,703 A * 5/1994 Schrenk ..... 425/132
5,735,105 A * 4/1998 Stroud et al. ..... 425/804
6,569,363 B1 * 5/2003 Schurig et al. ..... 425/804
6,719,867 B1 4/2004 Mileti et al.

FOREIGN PATENT DOCUMENTS

EP 1 116 574 7/2001
WO WO 2004/048204 6/2004

* cited by examiner

*Primary Examiner*—Yogendra Gupta
*Assistant Examiner*—Thu Khanh T Nguyen
(74) *Attorney, Agent, or Firm*—Schmeiser, Olsen & Watts, LLP

(57) ABSTRACT

The present invention is directed to a bitumen bale capsule, capsule dispenser and bale strip former for viscous bitumen products comprising a bitumen bale capsule; a capsule dispenser (L) in order to position the said PE encapsulating capsule inline with a plurality of dispensing valves (F) and a plurality of forming nozzles (M); a bitumen bale strip former for converting the said round PE encapsulated tubes into flat strips suitable for baling. The overall function of the said bitumen bale capsule is to encapsulate viscous bituminous products forcing through the internal core of the said capsule. The said products exiting the said encapsulation process in the form of a PE round tube are converted into a flat strip suitable for baling utilizing both of the said capsule dispenser and the said bale strip former.

16 Claims, 5 Drawing Sheets

BITUMEN BALE CAPSULE, CAPSULE DISPENSER, AND BALE STRIP FORMER FOR VISCOUS BITUMEN PRODUCTS

This non-provisional application claims priority under 35 U.S.C. § 119(a) on Patent Application No. PI20052601 filed in Malaysia on Jun. 8, 2005, the entire contents of which are hereby incorporated by reference.

FIELD OF INVENTION

The present invention relates to a bitumen bale capsule, capsule dispenser and bale strip former and more particularly, to a bitumen bale capsule, capsule dispenser and bale strip former for viscous bitumen products that encapsulates the bitumen products in a round PE tube and further converts into flat strips which are used for baling process thereafter.

RELATED APPLICATIONS

This application incorporates by reference patent application Ser. No. 11/1388626, entitled "Process for Preparing Bitumen/Asphalt Bale", filed on May 16, 2006.

BACKGROUND OF THE INVENTION

Description of the Related Art

Known prior art for encapsulation of the bitumen products and its related field includes U.S. Pat. No. 4,539,262 dated Sep. 3, 1985 to Hurst; U.S. Pat. No. 5,254,385 dated Oct. 19, 1993 to Hazlett; WO Pat. Application No. 2004048204 dated Nov. 19, 2003 of Pörmer Ingenieurgesellschaft MBH.

Some related heat sealing of thermoplastic films is known from U.S. Pat. No. 6,719,867 dated Apr. 13, 2004 to Mileti et al.; EP Pat. No. 1,116,574 dated Aug. 7, 2002 to Sealed Air Corporation.

U.S. Pat. No. 4,539,262 states an insulating material in the form of a body comprising expanded plastics beads which are each encapsulated in bitumen or a bituminous compound which is free from solvents, light oils, emulsifiers or other liquifying agents, such encapsulation having been formed by a hot process, the encapsulated beads having been subsequently pressed together and distorted to form a body with voids between the beads substantially eliminated.

U.S. Pat. No. 5,254,385 provides an encapsulated asphalt which is comprised of an asphalt cement or modified asphalt cement encapsulated by a polymeric coating (examples: ethylene vinyl acetate copolymer, ethylene-acrylic acid copolymer, polyethylene, polypropylene, etc.). The pellet of encapsulated asphalt is of such a size that it may be handled transported and stored at ambient temperatures and in much the same manner as grain, aggregate, or other granular materials. The encapsulated asphalt cement or modified asphalt cement will not suffer from degradation due to prolonged storage. The polymeric coating material and thickness may be chosen such that the coating will not alter the asphalt properties significantly, or may be used as a modifier for the asphalt which will be incorporated into the asphalt at the point of use.

WO Pat. Application No. 2004048204 relates to a method for packing bitumen, especially road bitumen, in bulk disposable transport units for the cold transportation of bitumen. The aim of the invention is to be able to fill and recycle such disposable transport units (13) in a targeted manner. To this end, said disposable transport units are produced from a flexible plastic material having a melting point of between 20° and 50° C. above the softening point of the bitumen, the bitumen being cooled almost to the softening point of the respectively processed bitumen before the units are filled. The invention also relates to an installation for carrying out said method, said installation comprising a plate heat exchanger (6) for cooling the bitumen, at the output of which a temperature difference between the coolant and the bitumen is maintained between 10° and 25° C.

U.S. Pat. No. 6,719,867 narrates a heat sealing/severing device for heat-sealing thermoplastic films together. The device includes front and rear opposing jaws that are moveable between an open position and a closed position. The open position defines a zone for inserting the thermoplastic films between the front and rear jaws. In the closed position, the front and rear jaws are proximate each other to compress the thermoplastic films together. The rear jaw includes a resilient portion facing the front jaw. The heating element of the device may have a cross-sectional thickness no less than 0.55 times the cross-sectional thickness of the resilient portion. A front jaw release sheet (e.g., an unreinforced fluoroplastic) may be positioned between the insertion zone and the heating element. The front jaw release sheet may engage the heating element when the front and rear jaws are in the closed position and disengage from the heating element when the front and rear jaws are in the open position. The present heat sealer can form consistent heat seals with fewer leaks and is especially useful in sealing and severing relatively thin thermoplastic films.

From a thorough search it is found from the above documents that bitumen bale capsule, capsule dispenser and bale strip former for viscous bitumen products have never been addressed earlier. Therefore, it is desired to address the present invention.

SUMMARY OF THE PRESENT INVENTION

Accordingly, the present invention is directed to a bitumen bale capsule, capsule dispenser and bale strip former for viscous bitumen products that substantially obviates one or more of the problems due to limitations and disadvantages of the related art.

It is, therefore, an object of the present invention to provide a bitumen bale capsule, capsule dispenser and bale strip former for viscous bitumen products in which bitumen bale capsules are encapsulated from viscous bituminous products by forcing through the internal core of the said capsule.

It is another object of the present invention to provide a bitumen bale capsule, capsule dispenser and bale strip former for viscous bitumen products in which the said products exiting the said encapsulation process in the form of a PE round tube are converted into a flat strip suitable for baling.

It is a further object of the present invention to provide a bitumen bale capsule, capsule dispenser and bale strip former for viscous bitumen products in which the said bitumen bale strip former converts the said round PE encapsulated tubes into flat strips suitable for baling.

It is another further object of the present invention to provide a bitumen bale capsule, capsule dispenser and bale strip former for viscous bitumen products in which a heat-sealing machine seals off the trailing end of the PE sleeve when it exits the said bitumen bale strip former.

Still another further object of the present invention is to provide a bitumen bale capsule, capsule dispenser and bale strip former for viscous bitumen products that is safe, eco-friendly, economical.

To achieve these and other advantages and in accordance with the purpose of the present invention, as embodied and broadly described, the bitumen bale capsule, capsule dispenser and bale strip former for viscous bitumen products in which:

(i) the said bitumen bale capsule having:

a moulded piece capsule body over which the PE/Polymer film is pushed into a bellows type formation;

a flange guide at one end of the said capsule body;

a raised diameter at other end of the said capsule body forming a collar;

a PE holding section of a suitable diameter for the size of the PE sleeve;

(ii) the said capsule dispenser in order to position the said PE encapsulating capsule inline with a plurality of dispensing valves and a plurality of forming nozzles, the said capsule dispenser having:

a plurality of guide channels to keep the said bitumen bale capsules in stacks;

a plurality of dispensing valves;

a capsule removal pulling arm for pulling the empty capsules down and further falling away of the said empty capsules and subsequently pulling the new capsules for loading in the said dispenser into the said inline position;

a spring loaded retaining latch located below the said inline capsules to ensure non-slipping of the said capsules from the said inline position;

(iii) a bitumen bale strip former for converting the said round PE encapsulated tubes into flat strips suitable for baling, the said former having:

a plurality of forming nozzles through which the said PE encapsulated tubes are forced, and force for forming the said round PE encapsulated tubes being applied by a piston and product head compressing the product in a viscous bitumen product dispenser tank;

a flange to bolt the said former to the said capsule dispenser;

a transition section to utilize minimum force to convert the said round PE encapsulated tubes into flat strips;

a transition piece in the said transition section having a very smooth internal surface in order to minimize resistance during forcing the said PE;

the overall function of the said bitumen bale capsule being encapsulation of viscous bituminous products forcing through the internal core of the said capsule, and the said product exiting the said encapsulation process in the form of a PE round tube being converted into a flat strip suitable for baling utilizing both of the said capsule dispenser and the said bale strip former.

The bitumen bale capsule, capsule dispenser and bale strip former for viscous bitumen products, wherein the section between the said flange guide and the said collar is the said PE holding section.

The bitumen bale capsule, capsule dispenser and bale strip former for viscous bitumen products, wherein the said PE holding section diameter is slightly less than the internal diameter of the said PE sleeve.

The bitumen bale capsule, capsule dispenser and bale strip former for viscous bitumen products, wherein the said flange guide of the said bitumen bale capsule fits in the guides of the said capsule dispenser and keeps the said capsule in a horizontal position.

The bitumen bale capsule, capsule dispenser and bale strip former for viscous bitumen products, wherein the length of the said PE sleeve holding section is such that the full length of one bale PE sleeve can be compressed within this length.

The bitumen bale capsule, capsule dispenser and bale strip former for viscous bitumen products, wherein the said collar of the said bitumen bale capsule is of bigger diameter than that of the said PE sleeve holding section.

The bitumen bale capsule, capsule dispenser and bale strip former for viscous bitumen products, wherein the said bigger diameter of the said collar keeps the said PE, when loaded, on the capsule from slipping off prematurely.

The bitumen bale capsule, capsule dispenser and bale strip former for viscous bitumen products, wherein the said flange guide of the said bitumen bale capsule has holes in the outer surface that are utilized by the mechanism that extracts the said empty capsule from the inline position between the said plurality of dispensing valves and the said plurality of forming nozzles.

The bitumen bale capsule, capsule dispenser and bale strip former for viscous bitumen products, wherein the said plurality of guide channels ensure that the said bitumen bale capsule are kept horizontal and in correct orientation.

The bitumen bale capsule, capsule dispenser and bale strip former for viscous bitumen products, wherein the inline loading position of the said bitumen bale capsule is between the said plurality of dispensing valves and the said plurality of forming nozzles.

The bitumen bale capsule, capsule dispenser and bale strip former for viscous bitumen products, wherein the said empty capsules are displaced and replaced automatically once a product strip has been fully encapsulated.

The bitumen bale capsule, capsule dispenser and bale strip former for viscous bitumen products, wherein the displacing and replacing of the said empty capsules are made with the coded instructions of the bar code stuck on the last section of the said PE sleeve pre-installed in the said bitumen bale capsule.

The bitumen bale capsule, capsule dispenser and bale strip former for viscous bitumen products, wherein the said capsule removal-pulling arm of the said capsule dispenser is activated by the said bar code.

The bitumen bale capsule, capsule dispenser and bale strip former for viscous bitumen products, wherein the said capsule removal-pulling arm of the said capsule dispenser can be pneumatic or motorized.

The bitumen bale capsule, capsule dispenser and bale strip former for viscous bitumen products, wherein the said capsule removal-pulling arm of the said capsule dispenser is rotated when activated by the said bar code.

The bitumen bale capsule, capsule dispenser and bale strip former for viscous bitumen products, wherein the bolting of the said flange of the said former to the said capsule dispenser may have optional tight sealing as the said bituminous product is encapsulated in PE.

The bitumen bale capsule, capsule dispenser and bale strip former for viscous bitumen products, wherein the lip of the said transition piece is the actual cross section of the said desired bituminous encapsulated strips.

The bitumen bale capsule, capsule dispenser and bale strip former for viscous bitumen products, wherein a heat sealing machine seals off the trailing end of the said PE sleeve when it exits the said bitumen bale strip former.

Additional features and advantages of the invention will be set forth in the description which follows, and in part will be apparent from the description, or may be learned by practice of the present invention. The objectives and other advantages of the invention will be realized and attained by the structure particularly pointed out in description and claims hereof as well as appended drawings.

BRIEF DESCRIPTION OF THE DRAWINGS

The invention is described in the following in greater detail by way of an example with reference to the accompanying drawings in which.

DESCRIPTION OF THE PREFERRED EMBODIMENT

Figure 1:
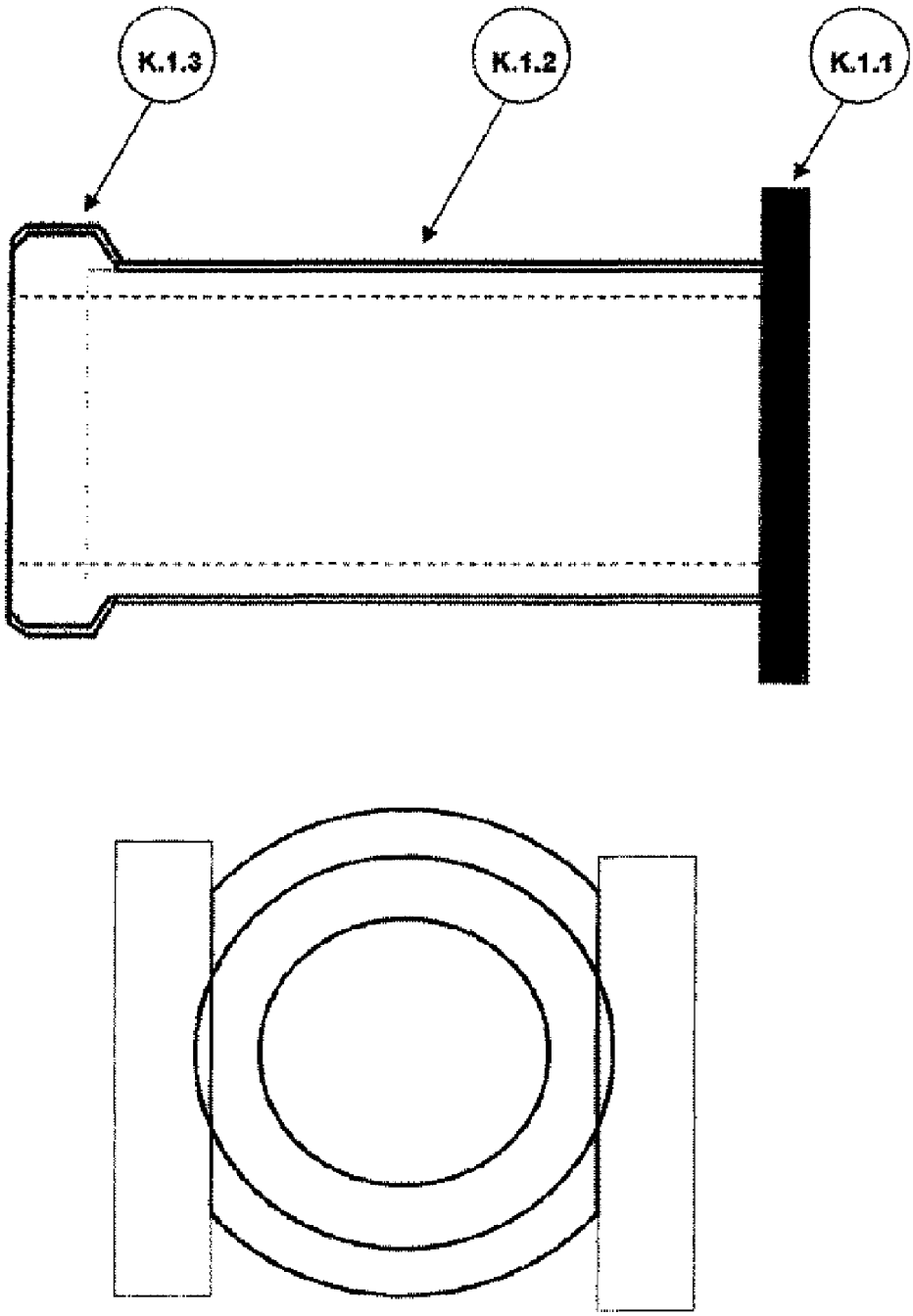
FIG. 1 illustrates a moulded bitumen bale capsule body on which the PE/Polymer film is pushed, according to the present invention.
Figure 2:
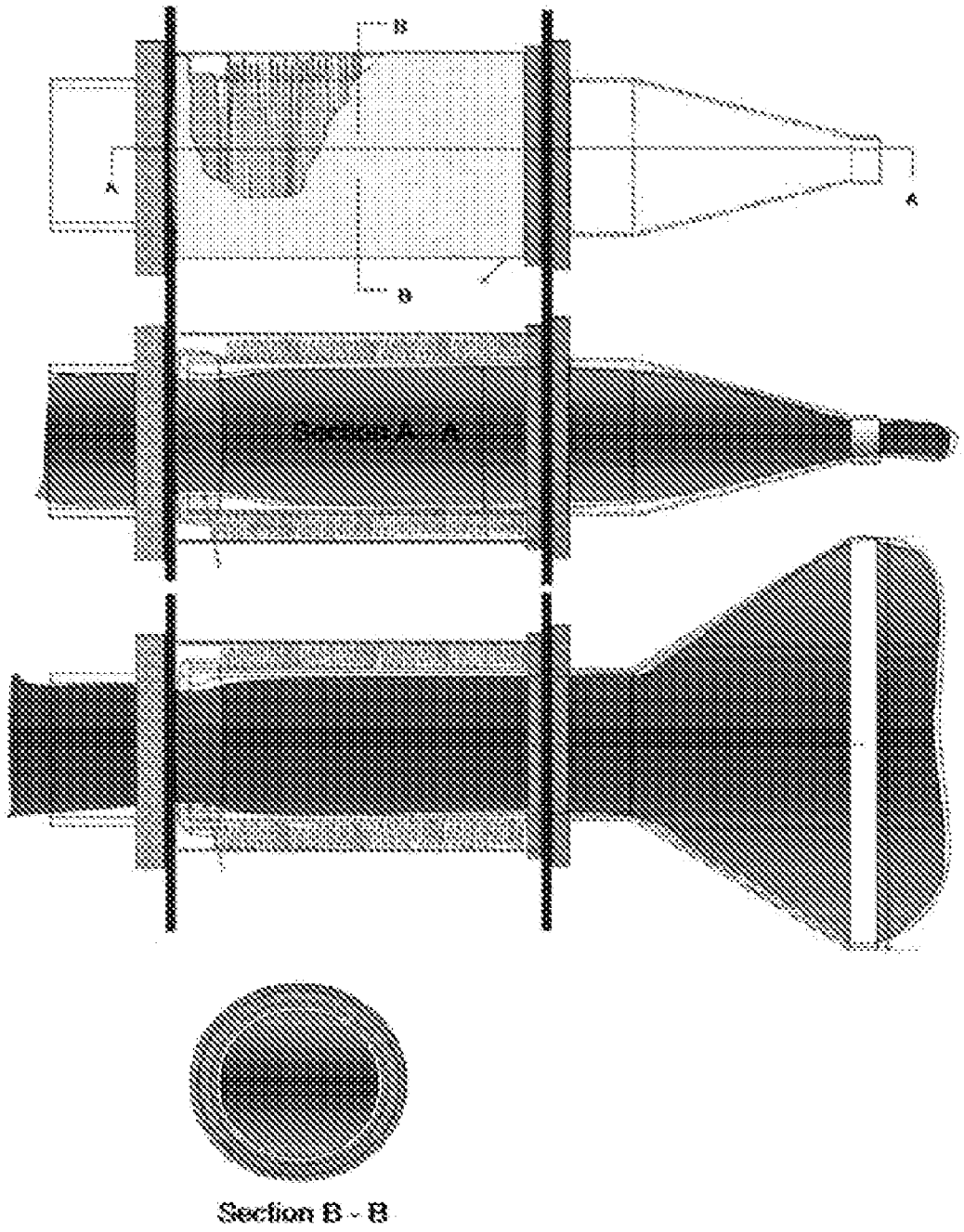
FIG. 2 depicts a bitumen PE/Polymer film capsule and its horizontal and vertical sectional views, according to the present invention.
Figure 3:
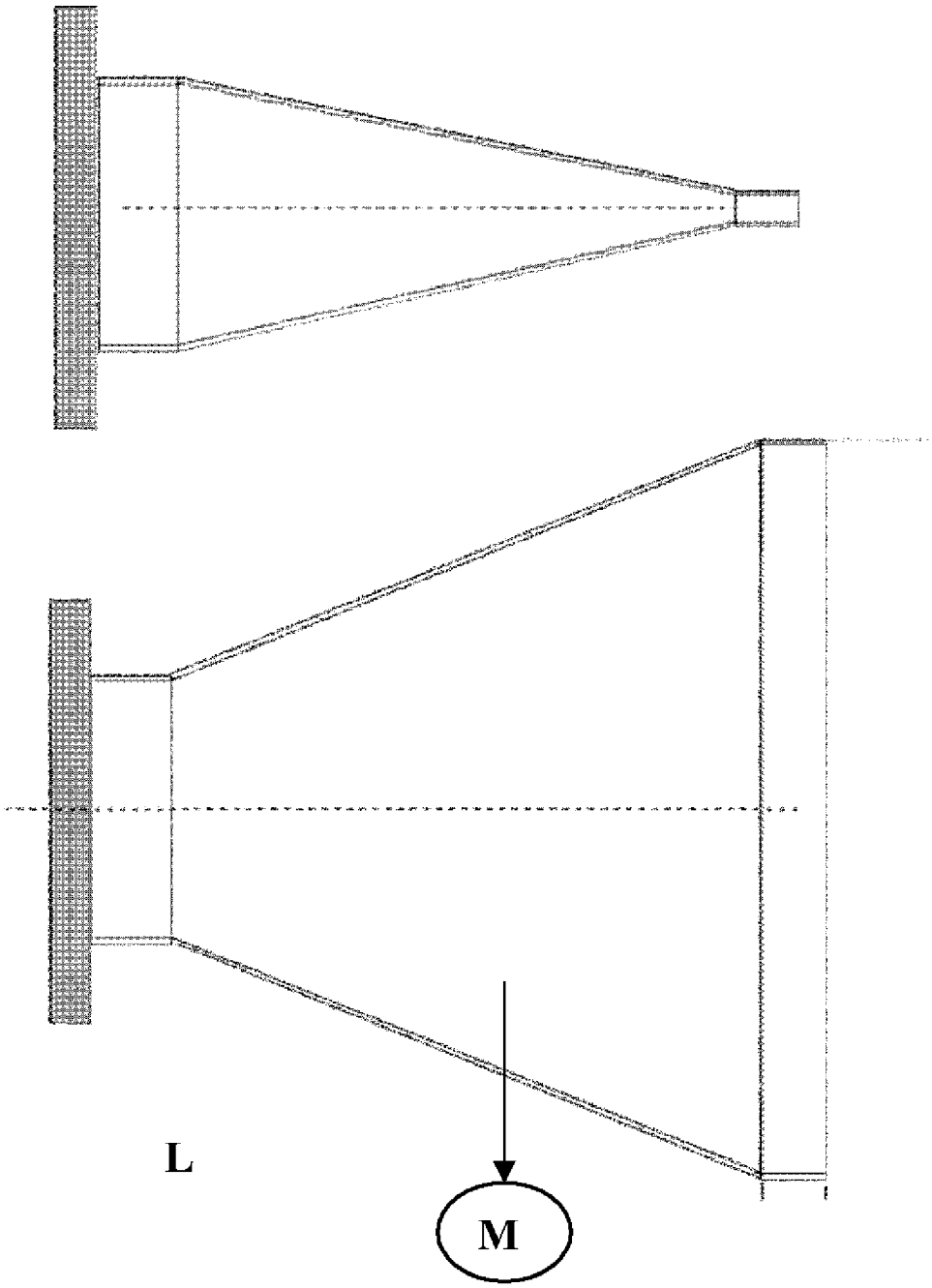
FIG. 3 illustrates a bitumen bale strip former, according to the present invention.
Figure 4:
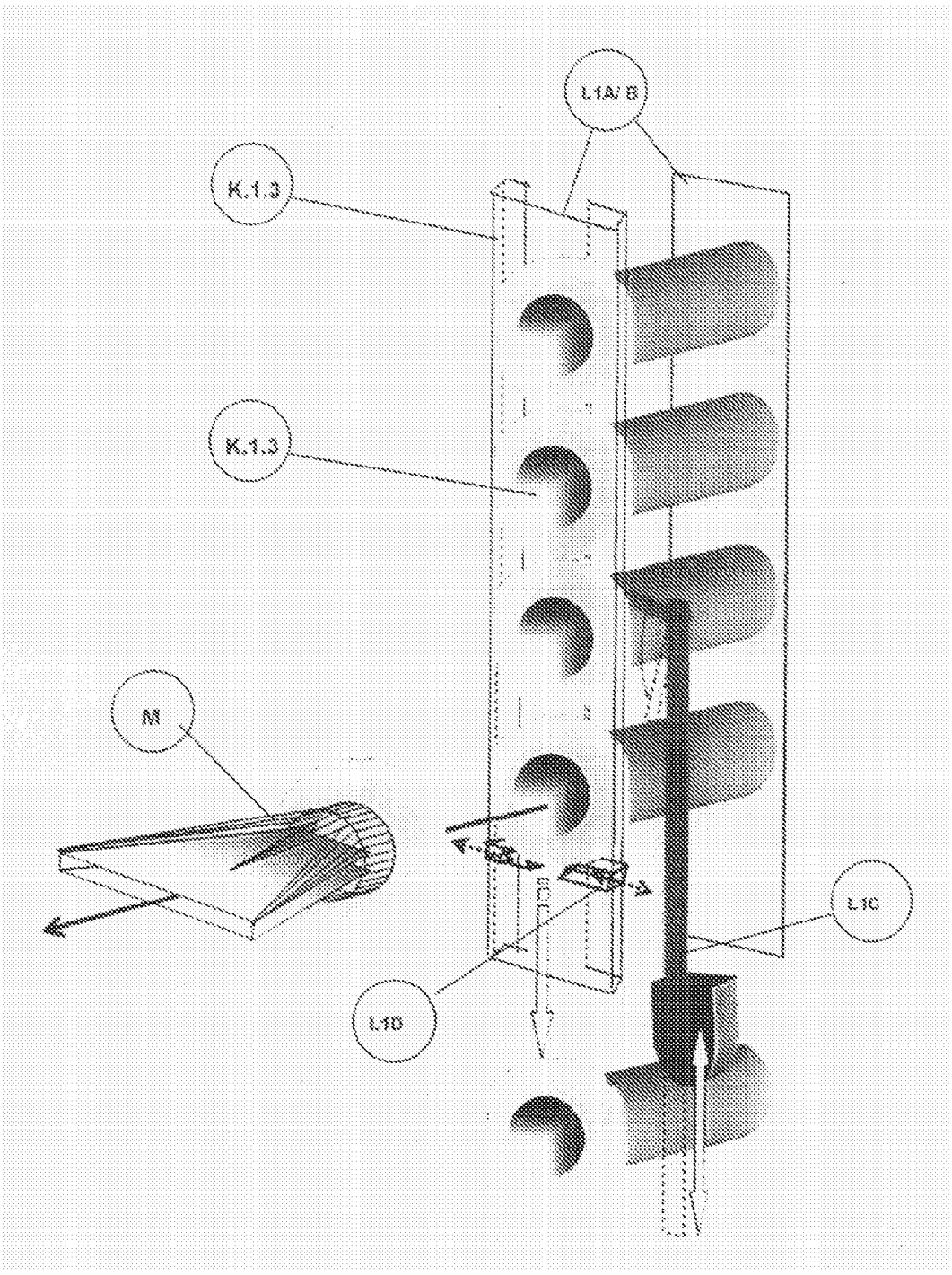
FIG. 4 illustrates a bitumen capsule dispenser with a bitumen bale strip former, according to the present invention.
Figure 5:
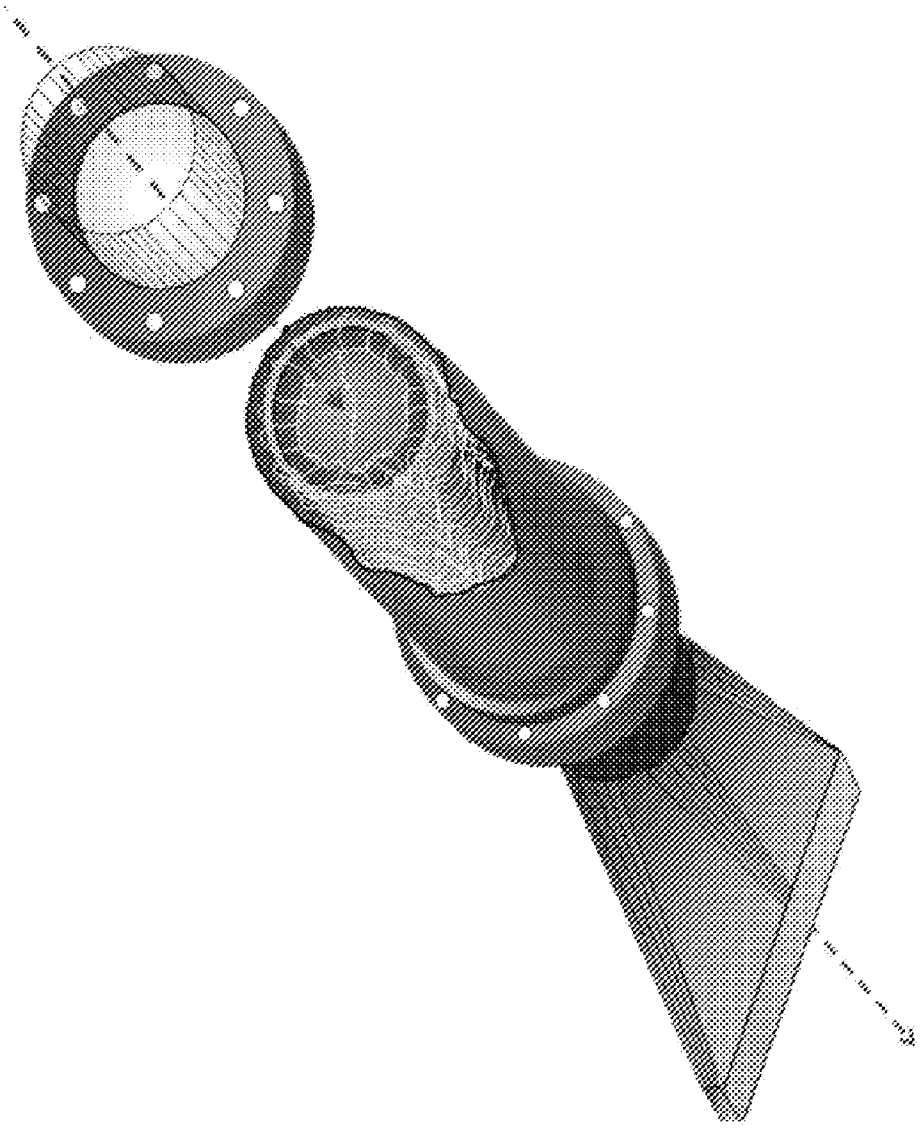
FIG. 5 shows the PE/Polymer film capsule with a bitumen bale strip former, according to the present invention.

The function of the bitumen bale capsule is to encapsulate viscous bituminous products that are forced through the internal core of the said capsule. When the said bituminous products enter the said capsule it comes up against the heat-sealed leading end of the PE/Polymer film sleeve that pushes it through the said capsule. This action in turn pulls the compressed PE/Polymer film off of the outer capsule thereby encapsulating the bituminous product.

The said bitumen bale capsule has a moulded piece capsule body (K1) over which the PE/Polymer film is pushed into a bellows type formation. The said capsule body (K1) has a flange guide (K1.1) at one end of the said capsule body (K1). A raised diameter at other end of the said capsule body (K1) forms a collar (K1.3) of the said capsule. The section between the said flange guide (K1.1) and the said collar (K1.3) is the PE holding section (K1.2). The said PE holding section (K1.2) is of a suitable diameter for the size of the PE sleeve. The said flange guide (K1.1) fits in the guides of the capsule dispenser (L) and keeps the said capsule in a horizontal position. The said PE holding section (K1.2) diameter is slightly less than the internal diameter of the said PE sleeve. The length of the said PE sleeve holding section (K1.2) is such that the full length of one bale PE sleeve can be compressed within this length. The said bitumen bale capsule is of bigger diameter than that of the said PE sleeve holding section (K1.2). The said bigger diameter of the said collar (K1.3) keeps the said PE, when loaded, on the capsule from slipping off prematurely. The said flange guide (K1.1) of the said bitumen bale capsule has holes in the outer surface that are utilized by the mechanism that extracts the said empty capsule from the inline position between the said plurality of dispensing valves (F) and the said plurality of forming nozzles (M).

The bitumen bale capsule, capsule dispenser and bale strip former for viscous bitumen products, according to the present invention, includes a capsule dispenser (L) in order to position the said PE encapsulating capsule inline with a plurality of dispensing valves (F) and a plurality of forming nozzles (M). The said capsule. dispenser (L) has a plurality of guide channels (L1A, L1B) to keep the said bitumen bale capsules in stacks, a plurality of dispensing valves (F), a capsule removal pulling arm (L.1.C) for pulling the empty capsules down and further falling away of the said empty capsules and subsequently pulling the new capsules for loading in the said dispenser (L) into the said inline position. The said capsule dispenser (L) also includes a spring loaded retaining latch (L.1.D) located below the said inline capsules to ensure non-slipping of the said capsules from the said inline position. The said plurality of guide channels (L1A, L1B) ensure that the said bitumen bale capsule are kept horizontal and in correct orientation. The inline loading position of the said bitumen bale capsule is between the said plurality of dispensing valves (F) and the said plurality of forming nozzles (M). The said empty capsules are displaced and replaced automatically once a product strip has been fully encapsulated. The displacing and replacing of the said empty capsules are made with the coded instructions of the bar code stuck on the last section of the said PE sleeve pre-installed in the said bitumen bale capsule. The said capsule removal-pulling arm (L.1.C) of the said capsule dispenser (L) is activated by the said bar code. The said capsule removal-pulling arm (L.1.C) of the said capsule dispenser (L) can be pneumatic or motorized and is rotated when activated by the said bar code Bolting of the said flange (M.01) of the said former to the said capsule dispenser (L) may have optional tight sealing as the said bituminous product is encapsulated in PE. Lip of the said transition piece (CF.004) is the actual cross section of the said desired bituminous encapsulated strips. A heat-sealing machine seals off the trailing end of the said PE sleeve when it exits the said bitumen bale strip former.

The bitumen bale capsule, capsule dispenser and bale strip former for viscous bitumen products, according to the present invention, further includes a bitumen bale strip former for converting the said round PE encapsulated tubes into flat strips suitable for baling.

The said bitumen bale strip former includes a plurality of forming nozzles (M). The said PE encapsulated tubes are forced through the said plurality of forming nozzles (M). Force for forming the said round PE encapsulated tubes is applied by a piston (C) and product head. The said product head compresses the said product in a viscous bitumen product dispenser tank (A). A flange (M.01) to bolt the said former to the said capsule dispenser (L) is included in the said bitumen bale strip former. A transition section (M.2) is designed in such a way that minimum force is required to convert the said round PE encapsulated tubes into flat strips. This is achieved by having a transition piece. This transition piece has a very smooth internal surface in order to minimize resistance during forcing the said PE.

The overall function of the said bitumen bale capsule is to encapsulate the said viscous bituminous products. The said products forces through the internal core of the said capsule. The said product exiting the said encapsulation process in the form of a PE round tube is converted into a flat strip suitable for baling utilizing both of the said capsule dispenser and the said bale strip former.

A heat-sealing machine seals off the trailing end of the PE sleeve when it exits the said bitumen bale strip former.

It is to be understood, however, that although the characteristics and advantages of the present invention have been set forth in the foregoing description, the disclosure is illustrative only, and changes may be made in the arrangement of the parts within the scope of the appended claims.

What is claimed is:

1. A bitumen strip forming apparatus for converting bitumen bale capsules into flat strips, the apparatus comprising:

(i) the bitumen bale capsule having:

a moulded piece capsule body (K1) over which the PE/Polymer film is pushed into a bellows type formation;

a flange guide (K1.1) at one end of the said capsule body (K1);

a raised diameter at other end of the said capsule body (K1) forming a collar (K1.3);

a PE holding section (K1.2) of a suitable diameter for the size of the PE sleeve;

(ii) a capsule dispenser (L) in order to position the said PE encapsulating capsule inline with a plurality of dispensing valves (F) and a plurality of forming nozzles (M), the said capsule dispenser (L) having:

a plurality of guide channels (L1A, L1B) to keep the said bitumen bale capsules in stacks;

a plurality of dispensing valves (F);

a capsule removal pulling arm (L1C) for pulling the empty capsules down and further falling away of the said empty capsules and subsequently pulling the new capsules for loading in the said dispenser (L) into the said inline position;

a spring loaded retaining latch (L.1.D) located below the said inline capsules to ensure non-slipping of the said capsules from the said inline position;

(iii) a bitumen bale strip former for converting the said round PE encapsulated tubes into flat strips suitable for baling, the said former having:

a plurality of forming nozzles (M) through which the said PE encapsulated tubes are forced, and force for forming the said round PE encapsulated tubes being applied by a piston (C) and product head compressing the product in a viscous bitumen product dispenser tank (A); a flange (M.O1) to bolt the said former to the said capsule dispenser (L); a transition section (M.2) to utilize minimum force to convert the said round PE encapsulated tubes into flat strips;

a transition piece (CF.004) in the said transition section (M.2) having a very smooth internal surface in order to minimize resistance during forcing the said PE;

the overall function of the said bitumen bale capsule being encapsulation of viscous bituminous products forcing through the internal core of the said capsule, and the said product exiting the said encapsulation process in the form of a PE round tube being converted into a flat strip suitable for baling utilizing both of the said capsule dispenser and the said bale strip former.

2. The apparatus according to claim 1, wherein the section between the said flange guide (K1.1) and the said collar (K1.3) is the said PE holding section (K1.2).

3. The apparatus according to claim 1, wherein the said PE holding section (K1.2) diameter is slightly less than the internal diameter of the said PE sleeve.

4. The apparatus according to claim 1, wherein the said flange guide (K1.1) of the said bitumen bale capsule fits in the guides of the said capsule dispenser (L) and keeps the said capsule in a horizontal position.

5. The apparatus according to claim 1, wherein the length of the said PE sleeve holding section (K1.2) is such that the full length of one bale PE sleeve can be compressed within this length.

6. The apparatus according to claim 1, wherein the said collar (K1.3) of the said bitumen bale capsule is of bigger diameter than that of the said PE sleeve holding section (K1.2).

7. The apparatus according to claim 6, wherein the said bigger diameter of the said collar (K1.3) keeps the said PE, when loaded, on the capsule from slipping off prematurely.

8. The apparatus according to claim 1, wherein the said flange guide (K1.1) of the said bitumen bale capsule has holes in the outer surface that are utilized by the mechanism that extracts the said empty capsule from the inline position between the said plurality of dispensing valves (F) and the said plurality of forming nozzles (M).

9. The apparatus according to claim 1, wherein the said plurality of guide channels (L1A, L1B) ensure that the said bitumen bale capsule are kept horizontal and in correct orientation.

10. The apparatus according to claim 1, wherein the inline loading position of the said bitumen bale capsule is between the said plurality of dispensing valves (F) and the said plurality of forming nozzles (M).

11. The apparatus according to claim 1, wherein the said empty capsules are displaced and replaced automatically once a product strip has been fully encapsulated.

12. The apparatus according to claim 11, wherein the displacing and replacing of the said empty capsules are made with the coded instructions of the bar code stuck on the last section of the said PE sleeve pre-installed in the said bitumen bale capsule.

13. The apparatus according to claim 1, wherein the said capsule removal pulling arm (L.1.C) of the said capsule dispenser (L) is activated by the said bar code.

14. The apparatus according to claim 1, wherein the said capsule removal pulling arm (L.1.C) of the said capsule dispenser (L) can be pneumatic or motorized.

15. The apparatus according to claim 1, wherein the said capsule removal pulling arm (L.1.C) of the said capsule dispenser (L) is rotated when activated by the said bar code.

16. The apparatus according to claim 1, wherein the bolting of the said flange (M.O1) of the said former to the said capsule dispenser (L).

* * * * *